US010173186B2

(12) United States Patent
Tomlinson et al.

(10) Patent No.: US 10,173,186 B2
(45) Date of Patent: Jan. 8, 2019

(54) PULSED GAS MIXING APPARATUS

(71) Applicant: Micro Matic USA, LLC, Brooksville, FL (US)

(72) Inventors: Michael A. Tomlinson, Brooksville, FL (US); David Dixon, Pine Hall, NC (US)

(73) Assignee: Micro Matic USA, LLC, Brooksville, FL (US)

( * ) Notice: Subject to any disclaimer, the term of this patent is extended or adjusted under 35 U.S.C. 154(b) by 99 days.

(21) Appl. No.: 15/282,042

(22) Filed: Sep. 30, 2016

(65) Prior Publication Data

US 2017/0095783 A1 Apr. 6, 2017

Related U.S. Application Data

(60) Provisional application No. 62/235,763, filed on Oct. 1, 2015.

(51) Int. Cl.
*B01F 13/02* (2006.01)
*B01F 3/00* (2006.01)

(52) U.S. Cl.
CPC ..... *B01F 13/0283* (2013.01); *B01F 13/0233* (2013.01); *B01F 2003/0028* (2013.01)

(58) Field of Classification Search
USPC ..... 366/106
See application file for complete search history.

(56) References Cited

U.S. PATENT DOCUMENTS 4,123,173 A * 10/1978 Bullock ..... B04B 5/0407 356/246
4,396,480 A * 8/1983 Hegedus ..... C25B 9/08 429/490
4,453,419 A * 6/1984 Engelke ..... G01F 1/46 73/861.66
5,622,117 A * 4/1997 Burian ..... B61D 17/16 105/377.07
6,071,593 A * 6/2000 Lang ..... A01K 67/027 156/290
6,890,232 B2 * 5/2005 Lee ..... H01J 9/242 445/24
2003/0139242 A1 * 7/2003 Teves ..... F16G 1/06 474/263

* cited by examiner

*Primary Examiner* — Mark Halpern
(74) *Attorney, Agent, or Firm* — Burr & Forman LLP; Ryan M. Corbett

(57) ABSTRACT

A pulsed gas mixing apparatus is provided. The pulsed gas mixing apparatus may include a mixing plate having a top side that is substantially smooth, and a bottom side that includes a plurality of ribs. The pulsed gas mixing apparatus may also include a supply tube configured to be coupled to the mixing plate and supply a mixing gas that is used to mix the contents a container in which the pulsed gas mixing apparatus is installed.

20 Claims, 5 Drawing Sheets

PULSED GAS MIXING APPARATUS

CROSS-REFERENCE TO RELATED APPLICATION

This application claims the benefit of U.S. Provisional Patent Application No. 62/235,763, filed on Oct. 1, 2015, which is incorporated herein by reference in its entirety.

TECHNICAL FIELD

The present disclosure relates generally to an apparatus for mixing liquids in a container using a pulsed gas, such as air.

SUMMARY

A pulsed gas mixing system utilizes large bubbles of gas (typically air) rising from the bottom of a container to induce a mixing flow within a separated solution. A large flat single bubble provides the greatest efficiency and is typically induced by introducing a sudden pulse of gas below a flat round steel plate suspended a fixed distance from the floor of the container. Ideally, this will produce a toroid (donut shaped) bubble having an even cross-section around the entire circumference of the bubble. The forces resulting from the surface tension on the bubble will rapidly pull the bubble together into the desired saucer (large flat) shape.

With respect to mixing efficiency using a pulsed gas system, the greatest efficiency is achieved by limiting the number of bubbles, and maximizing the size of the bubbles. In other words, the mixing is less efficient as the number of small bubbles increases. In addition, the efficiency increases as the number of large-sized bubbles decreases. Therefore, the most efficient solution is using one large, flat bubble.

The above-described method of creating the single flat bubble is generally reliable when the round steel plate can be precisely manufactured and accurately placed and leveled at the bottom of the container. Typically it is secured to the base of the container to maintain its precision. However, this methodology cannot be used when the container is semi-permanent, disposable, or recyclable. Also this methodology cannot be used when the mixing system is relocated from one container to the next. In these cases, the level, alignment, and spacing from the base are all subject to variation.

When the level, alignment, and spacing from the base of the container are irregular or varying, the bubble shape and size may not be reliably produced. Even if the toroid shape is produced, it is typically irregular and can break apart into multiple bubbles. More typically a series of smaller bubbles may be ejected from a single side of the plate. These multiple smaller bubbles still produce a mixing flow, however with reduced efficiency.

FIG. 1 depicts an example of a device used in the related art for producing a gas bubble in a mixing system. As shown in FIG. 1, the device includes a rigid steel plate 100 at the end of a rigid steel tube 105 extending down from the top of the container 110, and scaled to fit a correct distance to the bottom of the container 110. However, this method is often too expensive in relation to the cost of the container and may not repeatedly provide the correct spacing from the bottom. Additionally small movements such as flexing in the top of the container 110 can cause large variations in the positioning of the plate 100 at the bottom of the container 110. These variations in the plate positioning create mixing inefficiency due to an increased number of bubbles, smaller bubbles, etc.

Alternatively, the rigid steel tube can be replaced with a compressible plastic tube 205, as shown in FIG. 2. In addition, feet or stand-offs (not shown) can be added to the steel mixing plate 200. In this configuration the plate 200 is pressed down to a fixed distance from the base of the container 210. This resolves the location and spacing issues of the above configuration, however the plate 200 will only be as level as the base of the container 210. Furthermore, the buoyancy effect of the gas spreading unevenly across the face of the plate 200 may produce an uneven lifting force which will increase the unevenness. Accordingly, an improved pulsed gas mixing apparatus is needed that reliably mixes the liquid in a variety of applications.

According to an aspect of one or more exemplary embodiments there is provided a pulsed gas mixing apparatus that provides for more consistent generation of gas bubbles that efficiently mix the contents of the container. The pulsed gas mixing apparatus may include a mixing plate having a top side and bottom side. The top side may be substantially smooth, and the bottom side may have a plurality of ribs.

The ribs of the mixing plate may radiate outwardly from the center of the mixing plate to an outer edge of the mixing plate. The mixing plate may include one or more feet coupled to one or more of the outer edge of the mixing plate and one or more of the plurality of ribs. At least one of the plurality of ribs may be substantially triangular-shaped having a first height near the center the mixing plate that is greater than a second height near the outer edge of the mixing plate. The mixing plate may be substantially circular. The mixing plate may also, or alternatively, be conically-shaped.

The one or more feet of the pulsed gas mixing apparatus may be disposed along the outer edge of the mixing plate. The one or more feet may be disposed where a rib of the first plurality of ribs intersects with the outer edge of the mixing plate. Alternatively, one or more feet may be disposed on one or more ribs of the plurality of ribs. The ribs may be substantially equidistantly-spaced from each other. In addition, at least one of the ribs of the plurality of ribs may be a spiral rib.

According to one or more exemplary embodiments, the pulsed gas mixing apparatus may also include a supply tube configured to be coupled to the mixing plate, and to supply a mixing gas. The supply tube may include one or more pluralities of ribs that extend circumferentially around the supply tube. The supply tube may include two sets of ribs that are axially-spaced from each other. The number of ribs on the supply tube may equal the number of ribs in the mixing plate.

DETAILED DESCRIPTION OF EXEMPLARY EMBODIMENTS

Figure 1:
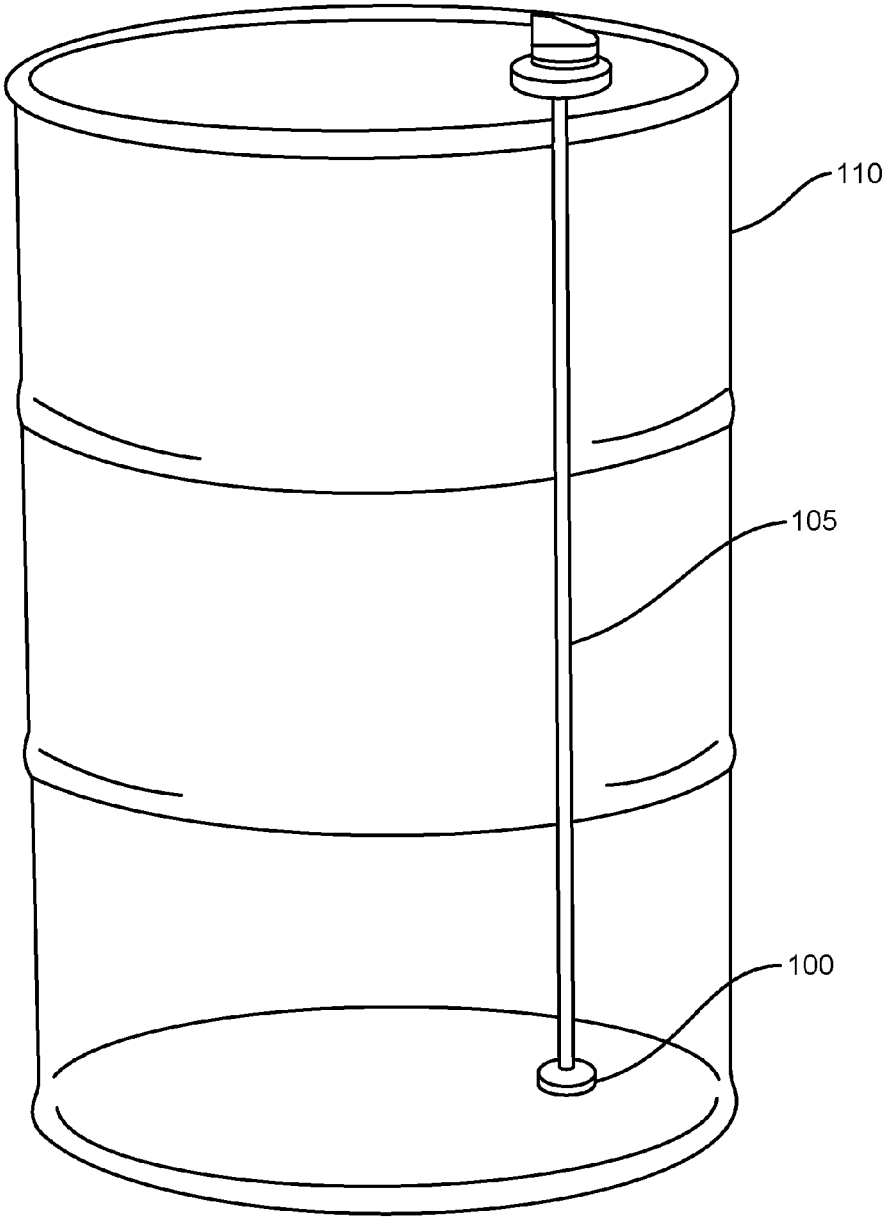
FIG. 1 illustrates a pulsed gas mixing plate apparatus according to the related art.
Figure 2:
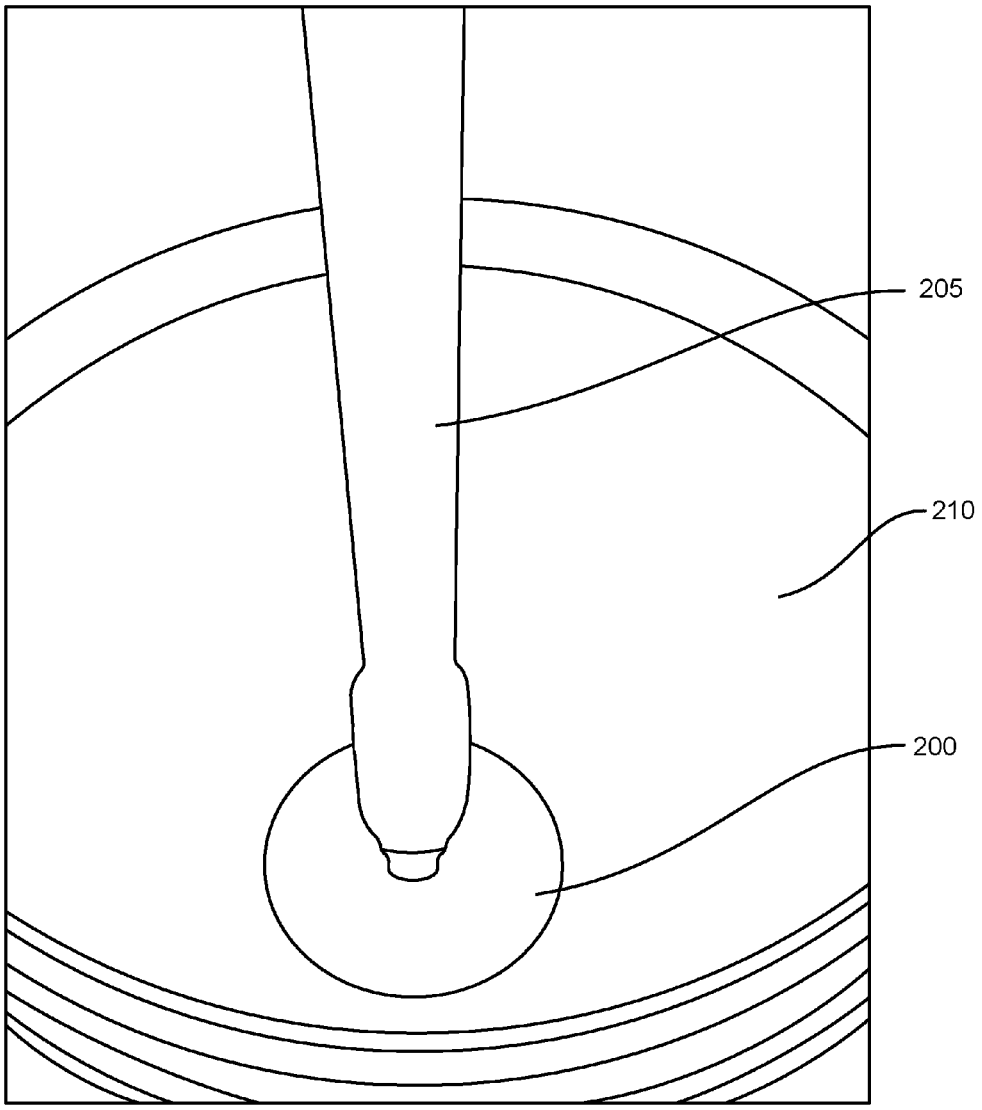
FIG. 2 illustrates another pulsed gas mixing plate apparatus according to the related art.

Reference will now be made in detail to the following exemplary embodiments, which are illustrated in the accompanying drawings, wherein like reference numerals refer to like elements throughout. The exemplary embodiments may be embodied in various forms without being limited to the exemplary embodiments set forth herein. Descriptions of well-known parts are omitted for clarity.

Figure 3:
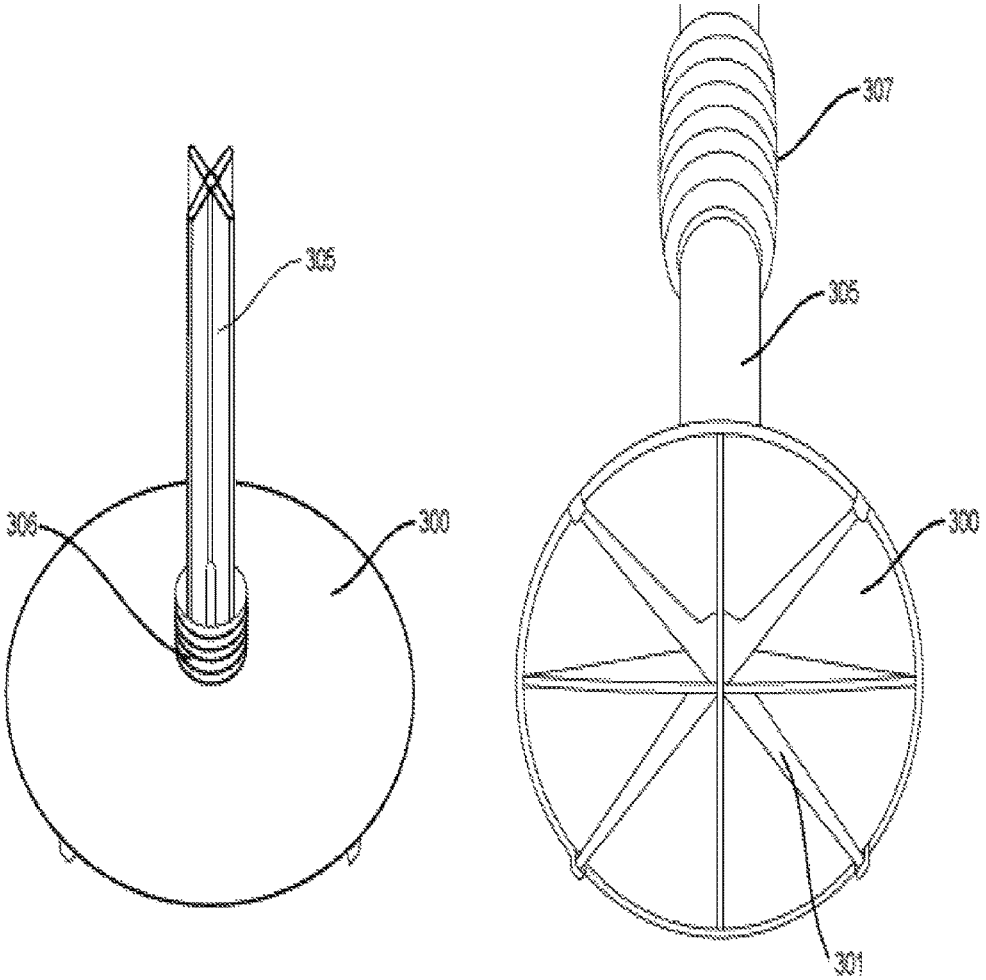
FIG. 3 illustrates a pulsed gas mixing apparatus according to an exemplary embodiment.

FIG. 3 depicts a pulsed gas mixing apparatus according to an exemplary embodiment. Referring to FIG. 3, the apparatus according to the exemplary embodiment may include a substantially circular plate 300 that may be made of plastic, steel, or other rigid materials. For example, the plate 300 may be made of molded plastic. The plate 300 may include one or more ribs 301 disposed on the bottom side of the plate. In the exemplary embodiment of FIG. 3, the plate 300 includes eight ribs 301 extending in a radial direction from the center of the plate 300, however the plate 300 may have any number of ribs 301.

The ribs 301 on the bottom side of the plate 300 may function to divide the gas flow into approximately even divisions, which may reduce the risk that the bubble will have an irregular cross section and/or that multiple small bubbles will be created. In addition, the tube 305 which supplies the mixing gas may also include ribs 306 to further ensure the equal division of gas flow. The tube 305 may have the same number of ribs 306 as the plate 300, or may have a different number of ribs than the plate 300. In addition, the tube 305 may have ribs 306 that extend different distances along an axial length of the tube 305. For example, in the exemplary embodiment of FIG. 3, the tube 305 may include four ribs 306 that continue up the supply tube 307 for several inches, and four ribs 306 that continue up the supply tube 305 by a shorter distance. The tube 305 may be made of plastic or steel, and is preferably a compressible plastic tube.

Figure 4:
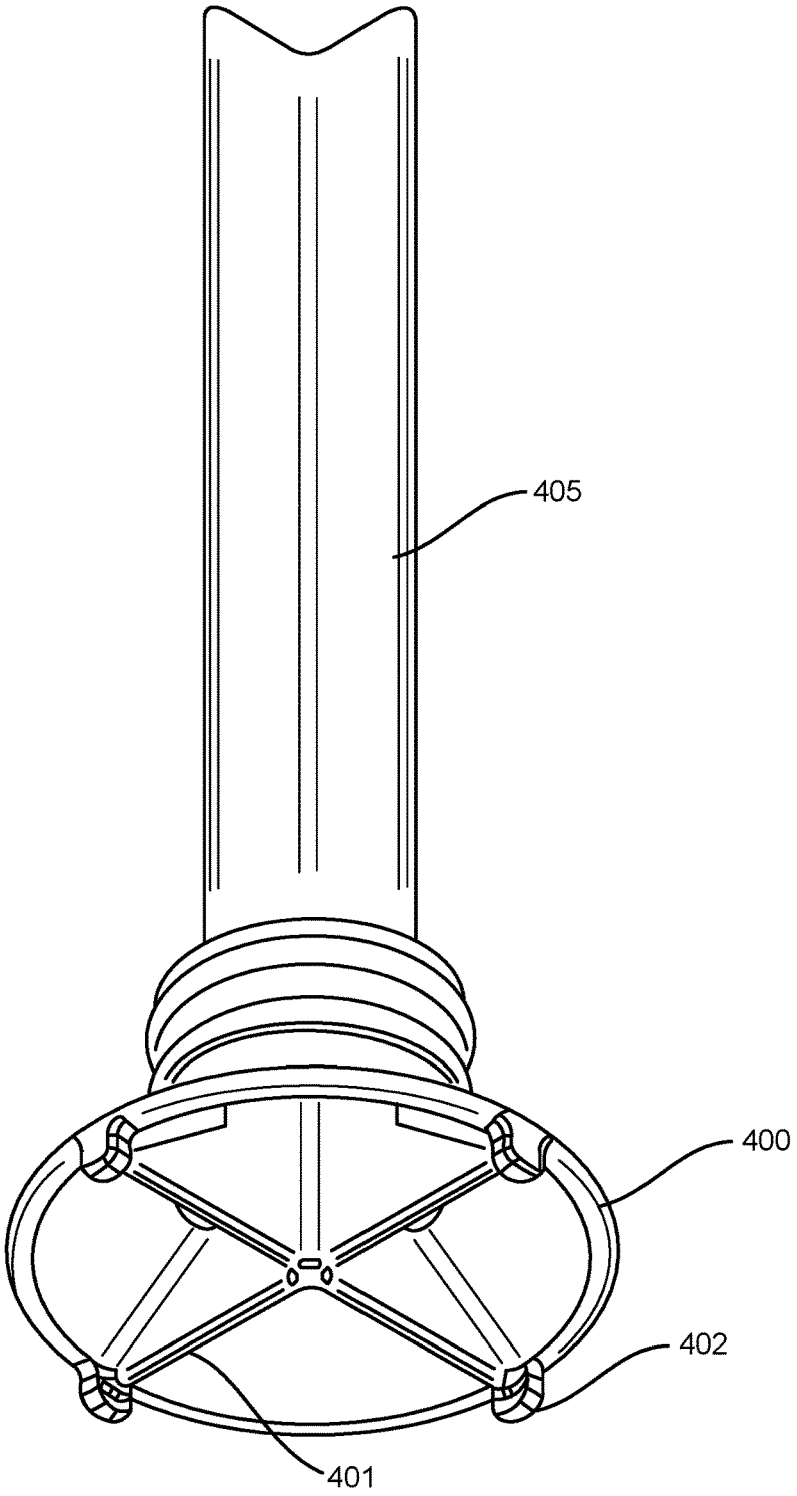
FIG. 4 illustrates a pulsed gas mixing apparatus according to another exemplary embodiment.

FIG. 4 depicts a mixing apparatus according to another exemplary embodiment. Referring to FIG. 4, the plate 400 may be conically-shaped to further ensure air flow balancing. The conical shape allows for a slight build of air pressure to resist air flow in sections of the plate 400 that are already receiving additional air flow. The conical shape also ensures that small bubbles do not prematurely roll off the edge of the plate 400. The mixing apparatus of this exemplary embodiment may include four ribs 401 that reinforce the conically-shaped plate 400, although a different number of ribs may be used. The apparatus may also include one or more feet 402 extending downward from the outer circumference of the plate 400. The one or more feet 402 may elevate the plate 400 an appropriate distance from the floor of the container. The one or more feet 402 may be pressed against the floor of the container by the compressive force of the gas tube 405. Although the exemplary embodiment of FIG. 4 is depicted with four ribs, the plate 400 may have greater or fewer ribs. In addition, the plate 400 may have any number of feet 402, and is not limited to the specific exemplary embodiment shown in FIG. 4. Moreover, the one or more feet 402 may be located anywhere along the circumference of the plate 400, or may be located on the bottom side of one or more ribs 401 within the circumference of the plate 400.

By dividing the gas flow, the ribs 401 balance the pressure and flow of the gas across the surface of the plate 400. The resulting consistent buoyancy force maintains the plate 400 in a level position that is roughly parallel with the bottom of the container. Balancing the gas flow and maintaining the plate 400 in a level position produces a more consistent and efficient bubble.

Although the ribs of the exemplary embodiment of FIGS. 3 and 4 extend radially from the center of the plate, the apparatus may include spiral ribs, or ribs that in some manner index 180 degrees from the center of the plate to the edge of the plate. This configuration would distribute minute variations in pressure from the high pressure side of the plate to the low pressure side, further leveling the plate.

Figure 5:
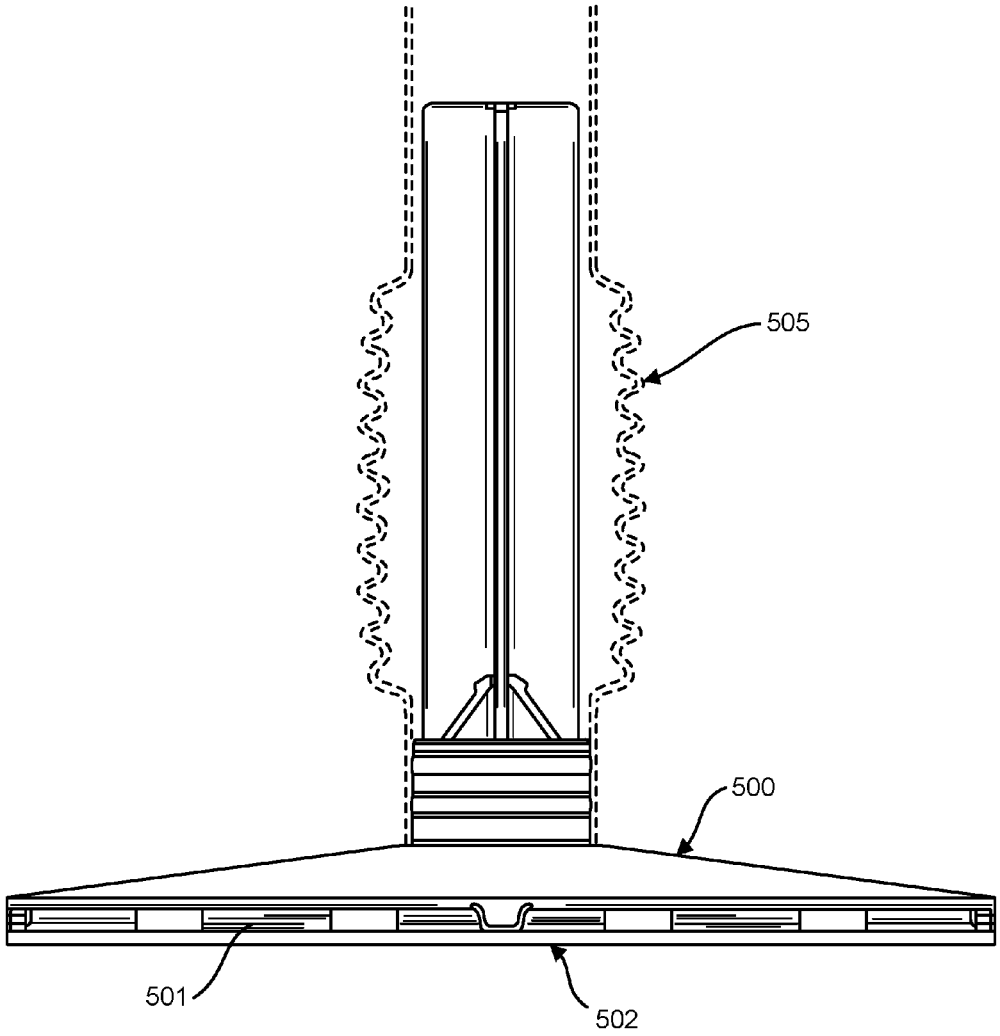
FIG. 5 illustrates a pulsed gas mixing apparatus according to another exemplary embodiment.

FIG. 5 shows pulsed gas mixing apparatus according to another exemplary embodiment. Referring to FIG. 5, the pulsed gas mixing apparatus according to the exemplary embodiment is similar to the exemplary embodiments of FIGS. 3 and 4. For example, the apparatus according to the exemplary embodiment includes a top plate 500 and ribs 501, but also includes a bottom plate 502 disposed below ribs 501. The tube 505 supplies the mixing gas through the top plate 500 and engages the ribs 501 and bottom plate 502. The bottom plate 502 directs the flow of the mixing gas laterally toward the edges of the top plate 500, and limits the amount of mixing gas that exits the top plate 500 from below. The ribs 501 divides the mixing gas into approximately even divisions as the mixing gas is channeled toward the edges of the top plate 500.

Although the inventive concepts of the present disclosure have been described and illustrated with respect to exemplary embodiments thereof, it is not limited to the exemplary embodiments disclosed herein and modifications may be made therein without departing from the scope of the inventive concepts.

What is claimed is:

1. A pulsed gas mixing apparatus comprising:

a mixing plate having a top side and a bottom side;

wherein the top side of the mixing plate is substantially smooth; and wherein the bottom side of the mixing plate includes a first plurality of ribs.

2. The pulsed gas mixing apparatus of claim 1, wherein the first plurality or ribs radiate outwardly from a center of the mixing plate to an outer edge of the mixing plate.

3. The pulsed gas mixing apparatus of claim 2, wherein the mixing plate comprises one or more feet coupled to one or more of the outer edge of the mixing plate and one or more of the first plurality of ribs.

4. The pulsed gas mixing apparatus of claim 3, wherein the one or more feet are disposed along the outer edge of the mixing plate.

5. The pulsed gas mixing apparatus of claim 4, wherein the one or more feet are disposed where a rib of the first plurality of ribs intersects with the outer edge of the mixing plate.

6. The pulsed gas mixing apparatus of claim 3, wherein the one or more feet are disposed on one or more ribs of the first plurality of ribs.

7. The pulsed gas mixing apparatus of claim 3, further comprising a bottom plate that is coupled to one or more of the feet so that the first plurality of ribs are disposed between the mixing plate and the bottom plate.

8. The pulsed gas mixing apparatus of claim 2, wherein at least one of the first plurality of ribs is substantially triangular-shaped having a first height near the center the mixing plate that is greater than a second height near the outer edge of the mixing plate.

9. The pulsed gas mixing apparatus of claim 2, further comprising a bottom plate that is coupled to one or more ribs of the first plurality of ribs so that the first plurality of ribs are disposed between the mixing plate and the bottom plate.

10. The pulsed gas mixing apparatus of claim 9, wherein a diameter of the bottom plate is approximately equivalent to a diameter of the mixing plate.

11. The pulsed gas mixing apparatus of claim 1, wherein the mixing plate is substantially circular.

12. The pulsed gas mixing apparatus of claim 1, wherein the mixing plate is conically-shaped.

13. The pulsed gas mixing apparatus of claim 1, wherein the first plurality of ribs are substantially equidistantly-spaced from each other.

14. The pulsed gas mixing apparatus of claim 1, wherein at least one rib of the first plurality of ribs is a spiral rib.

15. The pulsed gas mixing apparatus of claim 1, further comprising a supply tube configured to be coupled to the mixing plate, and to supply a mixing gas.

16. The pulsed gas mixing apparatus of claim 15, wherein the supply tube comprises a second plurality of ribs, wherein each of the ribs of the second plurality of ribs extends circumferentially around the supply tube.

17. The pulsed gas mixing apparatus of claim 16, wherein the supply tube further comprises a third plurality of ribs that are spaced axially along the supply tube from the second plurality of ribs.

18. The pulsed gas mixing apparatus of claim 17, wherein each of the ribs of the third plurality of ribs extends circumferentially around the supply tube.

19. The pulsed gas mixing apparatus of claim 17, wherein the number of ribs in the first plurality of ribs equals the combined number of ribs in the second and third pluralities of ribs.

20. The pulsed gas mixing apparatus of claim 1, wherein the first plurality of ribs are configured to interact with a gas.

* * * * *